US005503761A

United States Patent [19]

Ashcraft, Jr. et al.

[11] Patent Number: 5,503,761

[45] Date of Patent: Apr. 2, 1996

[54] TECHNICAL PENTAERYTHRITOL ESTERS AS LUBRICANT BASE STOCK

[75] Inventors: Thomas L. Ashcraft, Jr., Cedar Park, Tex.; Paul J. Berlowitz, East Windsor, N.J.; Max J. Wisotsky, Highland Park, N.J.; Dale D. Carr, Morristown, N.J.; Thomas G. Schaefer, Parlin, N.J.

[73] Assignee: Exxon Research & Engineering Co./Hatco Corp., Florham Park, N.J.

[21] Appl. No.: 284,777

[22] Filed: Aug. 2, 1994

[51] Int. Cl.[6] ..... C10M 105/38

[52] U.S. Cl. ..... 252/56 S

[58] Field of Search ..... 252/56 S

[56] References Cited

U.S. PATENT DOCUMENTS

| | | | |
|---|---|---|---|
| 2,961,406 | 11/1960 | McNeil, Jr. | 252/56 S |
| 3,247,111 | 4/1966 | Oberright et al. | 252/34.7 |
| 3,360,465 | 12/1967 | Warman | 252/56 S |
| 3,562,300 | 2/1971 | Chao et al. | 252/56 S |
| 4,049,563 | 9/1977 | Burrous | 252/49.9 |
| 4,175,045 | 11/1979 | Timony | 252/56 S |
| 4,826,533 | 5/1989 | Carr et al. | 252/56 S |
| 4,826,633 | 5/1989 | Carr et al. | 252/56 S |

FOREIGN PATENT DOCUMENTS

| | | | |
|---|---|---|---|
| 0498152 | 12/1992 | European Pat. Off. | C10M 171/00 |
| 0518567 | 12/1992 | European Pat. Off. | C10M 105/38 |
| 9324588 | 12/1993 | WIPO | C10M 171/00 |
| 9324587 | 12/1993 | WIPO | C10M 171/00 |

OTHER PUBLICATIONS

Sniegoski, "Selectivity of the Oxidative Attack on a Model Ester Lubricant", ASLE Transactions, vol. 20, pp. 282–286. (date unknown).

Chao et al, "Esters from Branched–Chain Acids and Neopentylpolyols And Phenols as Basic Fluids for Synthetic Lubricants", Div. Petroleum Chem., ACS meeting, Washington, DC, 1979, pp. 836–844.

Barnes et al, "Synthetic Ester Lubricants", Lubrication Engineering, Aug. 1957, pp. 454–458.

Niedzielski, "Neopentyl Polyol Ester Lubricants—Bulk Property Optimization", Ind. Eng. Chem., 15(1), pp. 54–58 (1976).

Bohner et al, "Properties of Polyester Fluids with Desirable Synthetic Lubricant Characteristics", J. Chem. Eng. Data, 7(4), pp. 547–553 (1962).

Sacks, "Synthetic Lubricants", SRI International, Report No. 125, May, 1979.

*Primary Examiner*—Jerry D. Johnson

*Attorney, Agent, or Firm*—James H. Takemoto; Joseph J. Allocca

[57] ABSTRACT

A synthetic ester base stock having reduced deposit formation which comprises the reaction product of technical pentaerythritol and a mixture of carboxylic acids. The mixture of carboxylic acids comprises (1) at least one $C_8$–$C_{10}$ carboxylic acid having 6 or less reactive hydrogens, (2) at least one $C_5$–$C_7$ carboxylic acid having 6 or less reactive hydrogens and (3) at least one $C_6$–$C_{10}$ carboxylic acid having 6 or more reactive hydrogens.

11 Claims, 2 Drawing Sheets

TECHNICAL PENTAERYTHRITOL ESTERS AS LUBRICANT BASE STOCK

BACKGROUND OF THE INVENTION

1. Field of the Invention

This invention relates to synthetic ester lubricant base stocks, more particularly to carboxylic acid esters of technical pentaerythriotol.

2. Background of the Invention

Synthetic ester base stocks for use in lubricant formulations are well known. One important factor for synthetic ester base stocks used in jet engine lubricants is the tendency of the esters to form deposits at high temperatures. This tendency to form deposits is particularly important to modern jet engines which operate under more severe requirements, e.g., higher operating temperatures.

U.S. Pat. No. 4,826,633 is directed to synthetic ester base stocks which do not contain esters of dipentaerythritol and which provide lubricant formulations having acceptable viscosity and pour point characteristics. Esters of monopentaerythritol are stated to provide synthetic ester lubricants which exhibit reduced tendency to form deposits whereas esters of dipentaerythritol lead to increased tendency to form deposits.

Because of the increased demands placed on synthetic lubricants by modern jet engines, there is a need for synthetic ester base stocks which have even further reduced tendencies to form deposits under operating conditions.

SUMMARY OF THE INVENTION

It has been discovered that a synthetic ester having reduced tendency to form deposits can be prepared from technical pentaerythritol and a mixture of $C_5$–$C_{10}$ carboxylic acids. The synthetic ester base stock having reduced deposit formation comprises the reaction product of:

(a) technical pentaerythritol, and (b) a mixture of $C_5$–$C_{10}$ carboxylic acids, said mixture comprising (1) from 5 to 20 mole %, based on total acids, of at least one $C_8$–$C_{10}$ carboxylic acid each having 6 or less reactive hydrogens, (2) from 50 to 65 mole %, based on total acids, of at least one $C_5$–$C_7$ carboxylic acid each having 6 or less reactive hydrogens, and (3) at least 15 mole %, based on total acids, of at least one $C_6$–$C_{10}$ carboxylic acid each having more than 6 reactive hydrogens;

wherein the resulting mixture of esters has a total reactive hydrogen content less than or equal to 6.0 gram atoms of reactive hydrogen per 100 grams of ester and has a kinematic viscosity of at least 4.6 cSt at 99° C. (210° F.) , a viscosity of less than 12,000 cSt at −40° C., a viscosity stability of ±6% for 72 hours at −40° C. and a pour point of −54° C. or lower. In another embodiment of the invention, there is provided a method for reducing deposit formation in an aviation turbine engine which comprises operating the engine with the synthetic ester base stock described above.

In contrast to the prior art, lubricants formulated with esters according to the invention produced from technical grade pentaerythritol esters exhibit lower tendencies to form deposits at temperatures between 282° C. to 327° C. than esters produced from monopentaerythritol esters alone. These temperatures are encountered in the lubricant systems of modern commercial gas turbine engines and the lower deposit formation tendency of technical pentaerythritol esters is important to the improved performance of the lubricant in these engines.

DESCRIPTION OF THE PREFERRED EMBODIMENTS

Figure 1:
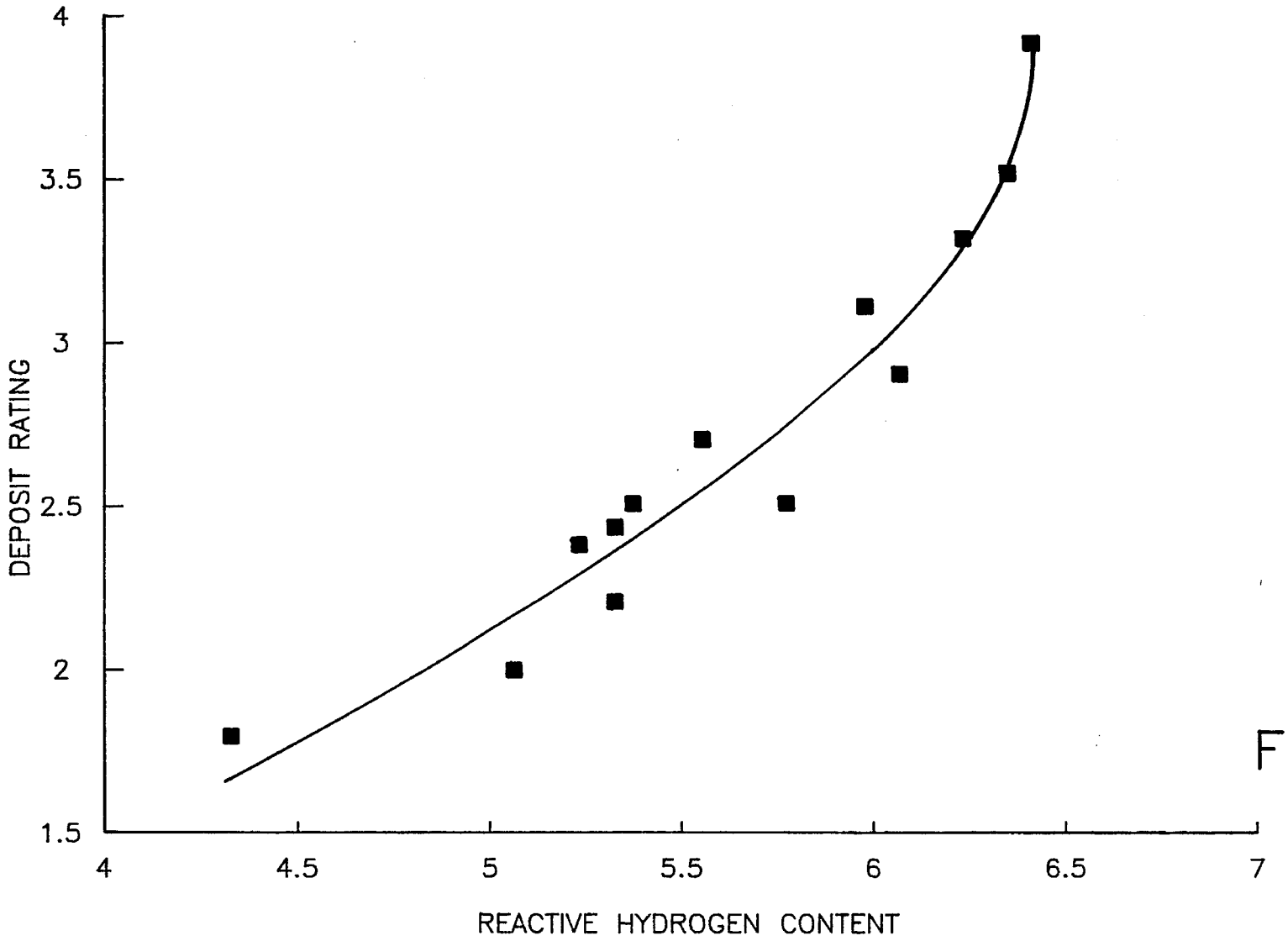
FIG. 1 is a graph of the deposit rating, which is a measure of the deposits formed by the test oil when dropped on the surface of a heated inclined panel as a function of the total reactive hydrogen content of the pentaerythritol ester.

The synthetic esters according to the invention are prepared from technical pentaerythritol and $C_5$–$C_{10}$ carboxylic acids. Technical pentaerythritol is a mixture which includes about 85% to 92% monopentaerythritol and 8% to 15% dipentaerythritol. A typical commercial technical pentaerythritol contains about 88% monopentaerythritol having the formula

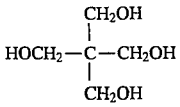

and about 12% of dipentaerythritol having the formula

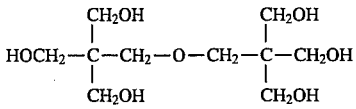

The technical pentaerytritol may also contain some tri- and tetrapentaerythritol that is normally formed as by-products during the manufacture of technical pentaerythritol.

The $C_5$–$C_{10}$ carboxylic acids which are used to prepare the synthetic ester lubricant base stocks are a blend of acids characterized by the number of reactive hydrogens. The term "reactive hydrogen" within the context of $C_5$–$C_{10}$ carboxylic acids refers to hydrogens bonded to either secondary or tertiary carbon atoms contained in the carbon chain of the acid, i.e.,

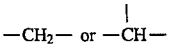

Each $C_5$–$C_{10}$ acid can be characterized by the number of reactive hydrogens. For example, straight chain $C_6$, $C_7$, $C_8$, $C_9$ and $C_{10}$ carboxylic acids have 8, 10, 12, 14 and 16 reactive hydrogens, respectively. The introduction of methyl side chain branching reduces the number of reactive hydrogens. Thus n-hexanoic acid has 8 reactive hydrogens, 2-methylpentanoic acid has 5 reactive hydrogens and 2,3-dimethylbutanoic acid has 2 reactive hydrogens. The number of reactive hydrogens as a function of total carbons in the acid vs. number of branches in the alkyl chain is given in Table 1.

TABLE 1

| TOTAL CARBONS | BRANCHES 0 | 1 | 2 | 3 | 4 | 5 | 6 |
|---|---|---|---|---|---|---|---|
| 3 | 2 | — | — | — | — | — | — |
| 4 | 4 | 1 | — | — | — | — | — |
| 5 | 6 | 3 | 0 | — | — | — | — |
| 6 | 8 | 5 | 2 | — | — | — | — |
| 7 | 10 | 7 | 4 | 1 | — | — | — |
| 8 | 12 | 9 | 6 | 3 | 0 | — | — |
| 9 | 14 | 11 | 8 | 5 | 2 | — | — |
| 10 | 16 | 13 | 10 | 7 | 4 | 1 | — |
| 11 | 18 | 15 | 12 | 9 | 6 | 3 | 0 |
| 12 | 20 | 17 | 14 | 11 | 8 | 5 | 2 |
| 13 | 22 | 19 | 16 | 13 | 10 | 7 | 4 |

The total reactive hydrogen content of the acid groups contained in a pentaerythritol ester base stock can be calculated from the concentration of each type of acid in the ester if the chemical structures of the acids are known. The reactive hydrogen content, in gram atoms of reactive hydrogen per 100 gm of base stock, is calculated as follows:

$$(100/M)\,(4Y+6(1-Y))\sum_{i=1}^{n} X_iH_i$$

$H_i$=number of reactive hydrogens for each acid ester $X_i$=concentration of each acid in acid mixture, mole fraction n=number of different acids in ester Y=concentration of monopenterythritol in technical grade, mole fraction M=average molecular weight of the pentaerythritol ester $X_iH_i$=number of reactive hydrogens contributed by each acid $$\sum_{i=1}^{n} X_iH_i =$$

the number of reactive hydrogens per average acid group

It has been discovered that the majority of acids reacted with technical pentaerythritol to form esters should have 6 or less reactive hydrogens in order to achieve improved cleanliness for the synthetic ester. Of the carboxylic acids having 6 or less reactive hydrogens, it is preferred that from 50 to 60 mole %, based on total amount of acids, are $C_5$–$C_7$ carboxylic acids. Preferred $C_5$ to $C_7$ carboxylic acids having 6 or less reactive hydrogens include n-pentanoic acid, 2-methylbutanoic acid, 2,2- and 3,3-dimethylbutanoic acid and 2,2-, 3,3- and 4,4-dimethylpentanoic acid, more preferably n-pentanoic acid and 2-methylbutanoic acid, especially n-pentanoic acid. A major amount of n-pentanoic acid allows maximizing benefits with regard to seal compatibility and cleanliness and provides greater oxidation stability compared to iso-$C_5$ (2-methylbutanoic) acid.

The amount of $C_8$–$C_{10}$ carboxylic acids having 6 or less hydrogens is preferably from 6 to 12 mole % based on the total amount of acids. A preferred $C_8$–$C_{10}$ acid is 3,5,5-trimethylhexanoic acid which provides excellent deposit control and balances the maximum content of $C_5$–$C_7$ acid so that the ester meets the physical properties listed in Table 2.

The third component, which is $C_6$–$C_{10}$ carboxylic acids having more than 6 reactive hydrogens, is preferably present in an amount from 45 to 15 mole %, more preferably from 44 to 28 mole %, based on the total amount of acids. Preferred acids are straight chain acids including n-hexanoic, n-heptanoic, n-octanoic, n-nonanoic and n-decanoic acids. Especially preferred acids are blends of n-heptanoic, n-octanoic and n-decanoic acids. These acids impart excellent viscosity temperature characteristics to the ester base stock and help improve elastomer seal compatibility. Commercially available acids may contain small amounts of other acids. For example, a $C_8$ and $C_{10}$ acid mixture may contain small amounts of $C_6$ and $C_{12}$ acids.

Synthetic ester base stocks which are used in aviation turbo oil formulations must meet certain requirements with regard to their viscosity and pour point characteristics. One such set of requirements are set forth in the U.S. Military MIL-L-23699 specifications. The target viscosity and pour point ranges for the base stock needed to meet the MIL-L-23699 specifications are in a finished oil shown in Table 2.

TABLE 2

| | |
|---|---|
| Kinematic Viscosity at 99° C. (210° F.) | 4.6–5.4 cSt |
| Viscosity at −40° C. | <12,000 cSt |
| Viscosity Stability at −40° C., 72 hours | ±6% |
| Pour Point | −54° C. |

synthetic ester base stocks according to the invention meet these requirements while at the same time reducing deposit formation.

The preparation of esters from alcohols and carboxylic acids can be accomplished using conventional methods. Technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

The synthetic ester base stocks may be used in the preparation of lubricant formulations, especially aviation turbo oils. A lubricant composition for use as an aviation turbo oil contains the synthetic ester base stock and at least one of the following additives: antioxidants, antiwear agents, extreme pressure additives, corrosion inhibitors, antifoamants, detergents, hydrolytic stabilizers and metal deactivators.

The invention is further illustrated by the following examples which includes a preferred embodiment.

EXAMPLE 1

An ester base stock in accordance with the invention was prepared as follows. The raw materials identified in Table 3 and a tin oxalate catalyst where charged into a stirred reactor capable of delivering 240°–255° C. and a vacuum of at least 29 inches of mercury. The reactor was provided with a nitrogen sparge or blanket.

The charge was heated to a reaction temperature between about 227° C. and 232° C. The water of reaction was collected in a trap during the reaction, while the acids were returned to the reactor. Vacuum was applied as needed in order to maintain the reaction. When the hydroxyl value was reduced to a sufficiently low level (a maximum of 5.0 mg KOH/gm) the bulk of the excess acid was removed by vacuum distillation. The residual acidity was neutralized with an alkali. The resulting ester base stock was dried and filtered.

TABLE 3

| Raw Material | Run 1 Amount Of Charge (gms) | Run 1 Mole % Of Acid | Run 2 Amount Of Charge (gms) | Run 2 Mole % Of Acid | Run 3 Amount Of Charge (gms) | Run 3 Mole % Of Acid |
|---|---|---|---|---|---|---|
| Technical PE | 374 | | 371 | | 367 | |
| n-$C_5$ acid | 729 | 60 | 824 | 60 | 596 | 50 |
| n-$C_7$ acid | 232 | 15 | 175 | 10 | 380 | 25 |
| n-$C_8$/$C_{10}$ acid | 277 | 15 | 375 | 18 | 272 | 15 |
| Iso-$C_9$ acid* | 188 | 10 | 255 | 12 | 185 | 10 |
| Total Charge: | 1800 | | 2000 | | 1800 | |
| 99° C. (210° F.) Visc, cSt | 4.86 | | 5.00 | | 4.97 | |
| −40° C. (−40° F.) Visc, cSt | 7510 | | 8500 | | 7950 | |
| Pour Point, °C. (°F.) | −54 (−65) | | −54 (−65) | | −57 (−70) | |

*3,5,5-trimethylhexanoic acid

The acid mixture is included in the reaction in an excess of about 10 to 15 wt % of the amount required for stoichiometric reaction with the quantity of pentaerythritol used. The excess acid is used to force the reaction to completion. The excess acid is not critical to carrying out the reaction, except that the smaller the excess, the longer the reaction time. The excess acid is present in the same proportion as that in the final product, it being assumed that the reaction rate for each of the acids is approximately equal. After the reaction is complete, the excess acid is removed by stripping and refining. Generally, the esterification reaction is carried out in the presence of a conventional catalyst.

The viscosity at 99° C. (210° F.) was between 4.86 and 5.00 cSt and at −40° C. (−40° F.) was between 7510 and 8500 cSt, determined in accordance with ASTM D-445 and ASTM D-2532, respectively. The pour points were between −54° C. to −57° C. (−65° F. and −70° F.) determined in accordance with ASTM D-97.

The acid makeup of the charges are set forth as preferred embodiments. It is to be understood that these preferred embodiments can be varied so that the makeup of the acid charge can vary over a range. For example, the range may include between about 50–60 mole % normal $C_5$ acid, between about 17.5 to 30 mole % normal $C_7$, and between 10 to 20 mole % of the normal $C_8$ and $C_{10}$ acid mixture. The iso-$C_9$ acid can be utilized between about 6 to 12 mole % of the acid charge.

The base stocks used in the following examples were blended into a finished turbo oil formulation suitable for applications covered by the MIL-L-23699 specifications by using a constant package of additives. The additive package contained an antioxidant consisting of a combination of diaryl amines, a commonly used metal passivator containing triaryl phosphates, a corrosion inhibitor consisting of an alkylated benzotriazole, an antiwear additive and a hydrolytic stabilizer.

The additive package was blended with a series of base stocks containing different reactive hydrogen contents as calculated from the equations indicated above. These formulated oils were subjected to deposit tests in the examples below.

EXAMPLE 2

This example illustrates the amount of deposit formation as a function of reactive hydrogen content of the base stocks using the additive package described above. The formulated oils were evaluated separately using the Inclined Panel Deposit Test ("IPDT").

The IPDT is a bench test consisting of a stainless steel panel electrically heated by means of two heaters inserted into holes in the panel body. The test temperature is held at 282° C. The panel temperature is monitored using a recording thermocouple. The panel is inclined at a 4° angle and oil is dropped onto the heated panel near the top, allowing the oil to flow the length of the panel surface, drip from the end of the heated surface and be recycled to the oil reservoir. The oil forms a thin moving film which is in contact with air flowing through the test chamber. Test duration is 24 hours. Deposits formed on the panel are rated on a scale identical to that used for deposits formed in the bearing rig test (FED. Test Method STD. No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test.

Deposit ratings were obtained using the IPDT for several base stocks which are predominately technical pentaerythritol esters and have various reactive hydrogen contents. The results are illustrated in FIG. 1 which presents the deposit formation as a function of the reactive hydrogen content. As can be seen from FIG. 1, deposit formation increases as the reactive hydrogen content increases.

Pentaerythritol esters containing acid distributions within the parameters of the subject invention produce reactive hydrogen contents below 6.0 and meet the physical property requirements outlined in the MIL-L-23699 specifications. These compositions simultaneously meet both the required MIL-L-23699 specifications and minimum deposit formation.

EXAMPLE 3

This example demonstrates that technical pentaerythritol esters form less deposits than comparable monopentaerythritol esters. Deposit data in Table 4 were taken in the IPDT test described in Example 2 at panel temperatures of 299° C. and 304° C. rather than 282° C. Two pairs of base stocks consisting of one mono (MONO) and one technical pentaerythritol (TECH) ester in each pair were tested. The additive package blended into the base stocks was described earlier.

The first pair of base stocks contain 75 mole % normal pentanoic (n-$C_5$) and 25 mole % 3,5,5-trimethyl hexanoic (i-$C_9$) acids. Each base stock has a reactive hydrogen content of 4.4 gram atoms of hydrogen per 100 gm of base stock. These results clearly indicate that the TECH base stock produces significantly less deposits than the MONO as indicated by the lower deposit ratings. Similar results were obtained by the second pair of base stocks in Table 4. The acid compositions are 24 and 14 mole % n-$C_5$ and i-$C_9$ acids in the MONO formulation and 30 and 6 mole % n-$C_5$ and i-$C_9$ acids in the TECH formulation. Normal heptanoic (n-$C_7$) acid made up the remainder of the acid compositions. Although the MONO base stock has a lower reactive hydrogen content (5.9 vs. 6.2 for TECH), the TECH base stock exhibits lower deposit formation. Thus, technical pentaerythritol base stocks exhibit lower deposit formations.

TABLE 4

| | Mole % | Reactive | Inclined Panel Deposit Test Rating | | |
|---|---|---|---|---|---|
| PE-Type | $C_5 + iC_9$ | Hydrogens | 299° C. | 304° C. | Avg. |
| MONO | 100 | 4.4 | 2.8 | 3.0 | 2.9 |
| TECH | 100 | 4.4 | 1.1 | 2.1 | 1.6 |
| MONO | 38 | 5.9 | 2.9 | 4.5 | 3.7 |
| TECH | 36 | 6.2 | 2.3 | 2.4 | 2.4 |

EXAMPLE 4

A second deposit test was used to determine the deposit formation of a series of mono and technical pentaerythritol base stocks with various reactive hydrogen contents. Each base stock was blended with an identical additive package described above. In this test, the oil is sprayed on the interior walls of an electrically heated stainless horizontal steel cylinder in the presence of flowing air. Test duration is 20 hours. About one liter of fresh oil is used for each test. Each oil is subjected to a series of tests in which the temperature of the heated cylinder is systematically increased.

Test temperatures range from 282° C. to 327° C. The temperature at which significant amounts of carbon deposits are formed ($T_i$) is noted for each base stock. The reference base stock in FIG. 2 has the lowest reactive hydrogen content and exhibited the highest test temperature ($T_o$) at which significant amounts of carbon deposits begin to form. The temperature difference, $T_o$–$T_i$, is defined as the Thermal Debit in °C and is plotted on the vertical axis. The reactive hydrogen content is plotted on the horizontal axis.

Figure 2:
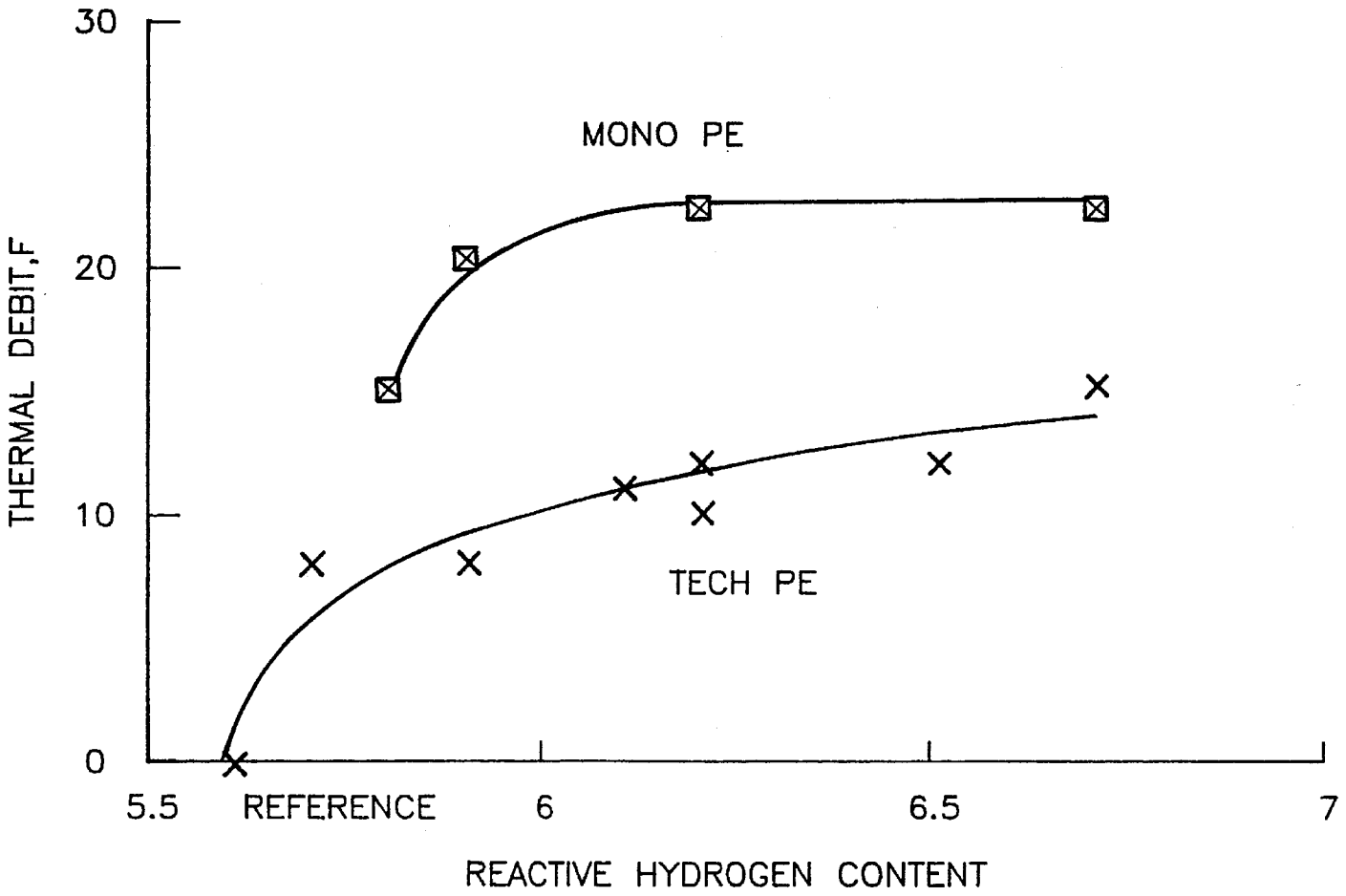
FIG. 2 is a graph of the thermal debit associated with deposit formation for a series of base stocks as a function of the total reactive hydrogen content of the base stock for both mono and technical pentaerythritol esters in the test oil.

The thermal debits for mono (MONO PE) and technical pentaerythritol (TECH PE) are shown in FIG. 2. The data clearly indicate that MONO PE esters have higher thermal debits than those for TECH PE esters for a given reactive hydrogen content. MONO PE base stocks form carbonaceous deposits at lower temperatures, confirming the higher deposition characteristics of MONO PE base stocks noted in Example 3.

Base stocks prepared according to the invention, when blended with the additive package described above produce finished turbo oils that meet MIL-L-23699 specifications.

What is claimed is:

1. A synthetic ester base stock having improved cleanliness which comprises the reaction product of:

(a) technical pentaerythritol, and (b) a mixture of $C_5$–$C_{10}$ carboxylic acids, said mixture comprising:

(1) from 5 to 20 mole %, based on total acids, of at least one $C_8$–$C_{10}$ carboxylic acid each having 6 or less reactive hydrogens, (2) from 50 to 65 mole %, based on total acids, of at least one $C_5$–$C_7$ carboxylic acid each having 6 or less reactive hydrogens, and (3) at least 15 mole %, based on total acids, of at least one $C_6$–$C_{10}$ carboxylic acid each having more than 6 reactive hydrogens;

wherein the resulting mixture of esters has a total reactive hydrogen content less than or equal to 6.0 gram atoms of reactive hydrogen per 100 grams of ester and has a kinematic viscosity of at least 4.6 cSt at 99° C., a viscosity of less than 12,000 cSt at −40° C., a viscosity stability of ±6% for 72 hours at −40° C. and a pour point of −54° C. or lower.

2. The base stock of claim 1 wherein the $C_8$–$C_{10}$ carboxylic acid having 6 or less reactive hydrogens is 3,5,5-trimethylhexanoic acid.

3. The base stock of claim 1 wherein the $C_5$–$C_7$ carboxylic acid having 6 or less reactive hydrogens is n-pentanoic acid or 2-methylbutanoic acid.

4. The base stock of claim 3 wherein the $C_5$–$C_7$ carboxylic acid is n-pentanoic acid.

5. The base stock of claim 1 wherein the $C_6$–$C_{10}$ carboxylic acid having more than 6 reactive hydrogen is selected from at least one of n-hexanoic, n-heptanoic, n-octanoic, n-nonanoic and n-decanoic acids.

6. The base stock of claim 5 wherein the $C_6$–$C_{10}$ carboxylic acid is selected from at least one of n-heptanoic, n-octanoic and n-decanoic acids.

7. A method for reducing deposit formation in an aviation turbine engine which comprises operating the engine with a lubricant based on a synthetic ester base stock which is the reaction product of:

(a) technical pentaerythritol, and (b) a mixture of $C_5$–$C_{10}$ carboxylic acids, said mixture comprising:

(1) from 5 to 20 mole %, based on total acids, of at least one $C_8$–$C_{10}$ carboxylic acid each having 6 or less reactive hydrogens, (2) from 50 to 65 mole %, based on total acids, of at least one $C_5$–$C_7$ carboxylic acid each having 6 or less reactive hydrogens, and (3) at least 15 mole %, based on total acids, of at least one $C_6$–$C_{10}$ carboxylic acid each having more than 6 reactive hydrogens;

wherein the resulting mixture of esters has a total reactive hydrogen content less than or equal to 6.0 gram atoms of reactive hydrogen per 100 grams of ester and has a kinematic viscosity of at least 4.6 cSt at 99° C., a viscosity of less than 12,000 cSt at −40° C., a viscosity stability of ±6% for 72 hours at −40° C. and a pour point of −54° C. or lower.

8. The method of claim 7 wherein the $C_8$–$C_{10}$ carboxylic acid having 6 or less reactive hydrogens is 3,5,5-trimethylhexanoic acid.

9. The method of claim 7 wherein the $C_5$–$C_7$ carboxylic acid having 6 or less reactive hydrogens is n-pentanoic acid or 2-methylbutanoic acid.

10. The method of claim 7 wherein the $C_6$–$C_{10}$ carboxylic acid having more than 6 reactive hydrogen is selected from at least one of n-hexanoic, n-heptanoic, n-octanoic, n-nonanoic and n-decanoic acids.

11. A synthetic ester base stock having improved cleanliness which comprises the reaction product of:

(a) technical pentaerythritol, and (b) a mixture of carboxylic acids having from 5 to 10 carbon atoms, said mixture comprising:

(1) from about 6 to 12 mole %, based on total acids, of at least one branched chain acid each having from 8 to 10 carbon atoms;

(2) from about 50 to 65 mole %, based on total acids, of n-pentanoic acid; and (3) at least about 15 mole %, based on total acids, of more than one linear acid each having from 6 to 10 carbon atoms;

wherein the resulting mixture of esters has a total reactive hydrogen content less than or equal to about 6.0 gram atoms of reactive hydrogen per 100 grams of ester, and has a kinematic viscosity of at least about 4.6 cSt at 99° C., a viscosity of less than about 9,000 cSt at –40° C., a viscosity stability of ± about 6% for 72 hours at –40° C. and a pour point of about –54° C. or lower.

* * * * *